US005984095A

United States Patent [19]

Kim

[11] Patent Number: 5,984,095

[45] Date of Patent: Nov. 16, 1999

[54] GOLF BAG

[76] Inventor: Eun-Ja Kim, 40 Bephany Dr., Commeck, N.Y. 11725

[21] Appl. No.: 09/098,510

[22] Filed: Jun. 17, 1998

[30] Foreign Application Priority Data

Apr. 15, 1998 [KR] Rep. of Korea ..... 98-13506

[51] Int. Cl.[6] ..... A63B 55/00

[52] U.S. Cl. ..... 206/315.6; 206/315.3; 206/315.8

[58] Field of Search ..... 206/315.2, 315.3, 206/315.6, 315.8

[56] References Cited

U.S. PATENT DOCUMENTS

| | | | |
|---|---|---|---|
| 1,711,344 | 4/1929 | Evans | 206/315.6 |
| 1,780,802 | 11/1930 | Sutcliffe | 206/315.6 |
| 1,968,723 | 7/1934 | Thorsen | 206/315.6 |
| 2,435,479 | 2/1948 | Thommen | 206/315.8 |
| 3,674,072 | 7/1972 | Shuto | 206/315.6 |
| 4,130,153 | 12/1978 | Zopf | 206/315.6 |
| 4,860,889 | 8/1989 | Lemieux et al. | 206/315.6 |
| 4,881,638 | 11/1989 | Cho | 206/315.6 X |
| 5,402,883 | 4/1995 | Shin | 206/315.6 X |
| 5,482,160 | 1/1996 | Perrin | 206/315.8 |
| 5,509,531 | 4/1996 | Patrick et al. | 206/315.6 |
| 5,638,954 | 6/1997 | Hsien | 206/315.8 |
| 5,769,220 | 6/1998 | Hong | 206/315.8 X |
| 5,860,520 | 1/1999 | Tang | 206/316.6 |

FOREIGN PATENT DOCUMENTS

| | | | |
|---|---|---|---|
| 324772 | 2/1930 | United Kingdom | 206/315.5 |
| 414168 | 8/1934 | United Kingdom | 206/315.5 |

*Primary Examiner*—Sue A. Weaver
*Attorney, Agent, or Firm*—Smith Patent Office

[57] ABSTRACT

A golf bag having an open top for arranging a plurality of golf clubs, a body coupled along the periphery of a lower end of the top, a bottom disposed along the periphery of a lower end of the body for closing up an internal space of the body and partitioning members fixed at the top for dividing the internal space. The bag comprises hitching protruders formed at both ends of the partitioning members and accommodating members installed along an inner side of the top for fixedly receiving the hitching protruders. The partitioning members of the present invention comprise vertical partitioning members and horizontal partitioning members all of which include inserting members and accommodating members for fixing the partitioning members inside the top, and both ends of the partitioning members are connected onto the accommodating members fixed at inner sides of the top, after the length thereof is adjusted in accordance with the width of the top. Thus the present invention only users one flexible type of partitioning member in manufacturing various sizes of golf bags, thereby improving manufacturing efficiency and reducing the manufacturing cost because the partitioning members can be widely used for various sizes of the top according to design changes.

6 Claims, 9 Drawing Sheets

GOLF BAG

BACKGROUND OF THE INVENTION

Field of the Invention

The present invention relates to a golf bag, and more particularly to a golf bag having partitioning members which divide an internal space thereof so as to be flexibly adjusted to various sizes in the top of the golf bag thereby improving assembling efficiency.

In general, golf is one of the popular sports that people enjoy as a leisure activity. Golf specifically calls for a set of golf clubs, 9 iron pieces, 3 wood pieces and a putter in a game. These golf clubs are stored in the golf bag for convenient carriage and are selectively used during the game.

As shown in FIG. 1, a conventional golf bag used for carrying a set of golf clubs during a game is constructed with an open top 110 for putting the clubs therethrough, a body 120 coupled from a lower portion of the top 110 along the periphery to a bottom 130, and the bottom 130 is connected to the body 120 for closing the open internal bottom space.

On the other hand, a golf bag of the so called organizer type is made with a plurality of separate regions by partitioning the internal space of the open top 110 for conveniently arranging the clubs. Partitioning members 140 are inserted for preventing the clubs stored in the bag from striking and damaging each other. The partitioning members 140 made of somewhat pliable fabric are connected between the top 110 and the bottom 130 for dividing the internal space of the body 120 into a plurality of regions.

As shown in FIG. 2, the upper portion of the partitioning members 140 are fixed by supporting bars 150 which horizontally penetrate the top 110 while the lower portion of the partitioning member 140 are fixed by a hitching plate 131 attached on the bottom 130. In other words, the upper portion of the partitioning members 140 are sewn around the supporting bars 150 and the hitching plate 131 is fastened at the bottom 130 from outside whereby the partitioning members 140 are fixed to connect between the top 110 and the bottom 130.

The supporting bars 150 for enabling both ends of the partitioning member 140 to be fixed at the top 110 penetrate through lateral portions of the top 110 and are horizontally fixed by cap nuts 151.

In addition, the hitching plate 131 is riveted, each rivet 132 at an equal distance therebetween, for fastening the partitioning member 140 which passes behind the hitching plate 131 and faces upward toward the top 110.

Furthermore, the body 120 and the bottom 130, as shown in FIG. 3, are also assembled by rivets 121, each positioned at a predetermined equal space therebetween around the periphery thereof.

Meanwhile, the top 110 may be classified into a mold type uniformly made of a synthetic material and a wire type sewn with fabric around a ring shaped wire 111, as illustrated in FIG. 2.

The body 120 which supports a whole shape of the golf bag may be classified into a cylindrical frame type made of a synthetic product with fabric attached thereto and a rod stay type made with a plurality of rods (not shown) vertically embedded at a predetermined identical interval around the peripheries of the top 110 and bottom 130, those being connected therebetween.

Accordingly, there is a disadvantage in a golf bag having a mold type of a top in that the top should be made with a diameter and a shape thereof in accordance with a size of the body 120, thereby increasing manufacturing costs to make a new mold for a synthetic top in response to the various sizes of the body 120. On the contrary, there is an advantage in the golf bag having the mold type of the top in that the golf bag may have a rod stay type of a body with cheap supporting rods which connect between the top and the bottom for maintenance of its shape, instead of a cylindrical frame of a body made of an expensive synthetic frame onto which fabric should be attached.

There is an advantage in a golf bag having a wire type of a top in that the ring shaped wire is simply adjusted lengthwise in accordance with a size of the top and sewn with fabric, thereby enabling a convenient use for various sizes of golf bags. In contrast, there are disadvantages in that the partitioning member for dividing an internal space of the top should be separately manufactured according to regulated sizes of golf bags, thereby increasing manufacturing cost, and the top and partitioning members should be manually assembled, thereby lowering efficiency of manufacture.

In addition, whichever type of top is used, rivets are used for coupling the body and the bottom in the conventional golf bag. Therefore, there is an additional disadvantage in the conventional golf bag in that it is impossible to disassemble the bottom from the body even when repair should be performed on a defect in the product.

SUMMARY OF THE INVENTION

The present invention is presented to solve the aforementioned problems and it is an object of the present invention to provide a golf bag having a wire type of a top, the bag including partitioning members whose length is conveniently controlled to a width of the top and which is easily assembled to the top for dividing the internal space of a body and storing various golf clubs according to the kinds thereof, thereby improving job efficiency and reducing manufacturing costs because the partitioning members may be widely used for various sizes of tops according to design changes thereof.

In order to achieve the aforementioned objects, there is provided a golf bag having an open top for arranging a plurality of golf clubs, a body coupled along the periphery of a lower end of the top, a bottom disposed along the periphery of a lower end of the body for closing up an internal space of the body and partitioning members fixed at the top for dividing the internal space, the bag comprising:

hitching protruders formed at both ends of the partitioning members; and accommodating members installed along an inner side of the top for fixing the hitching protruders, wherein the partitioning members of the present invention comprise vertical partitioning members and horizontal partitioning members all of which include inserting members and accommodating members for fixing the partitioning members inside the top, and both ends of the partitioning members are connected onto the accommodating members fixed at the inner sides of the top, after the length thereof is controlled in accordance with the width of the top, whereby only one flexible type of partitioning member may be used in manufacturing various sizes of golf bags.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENTS

Figure 1:
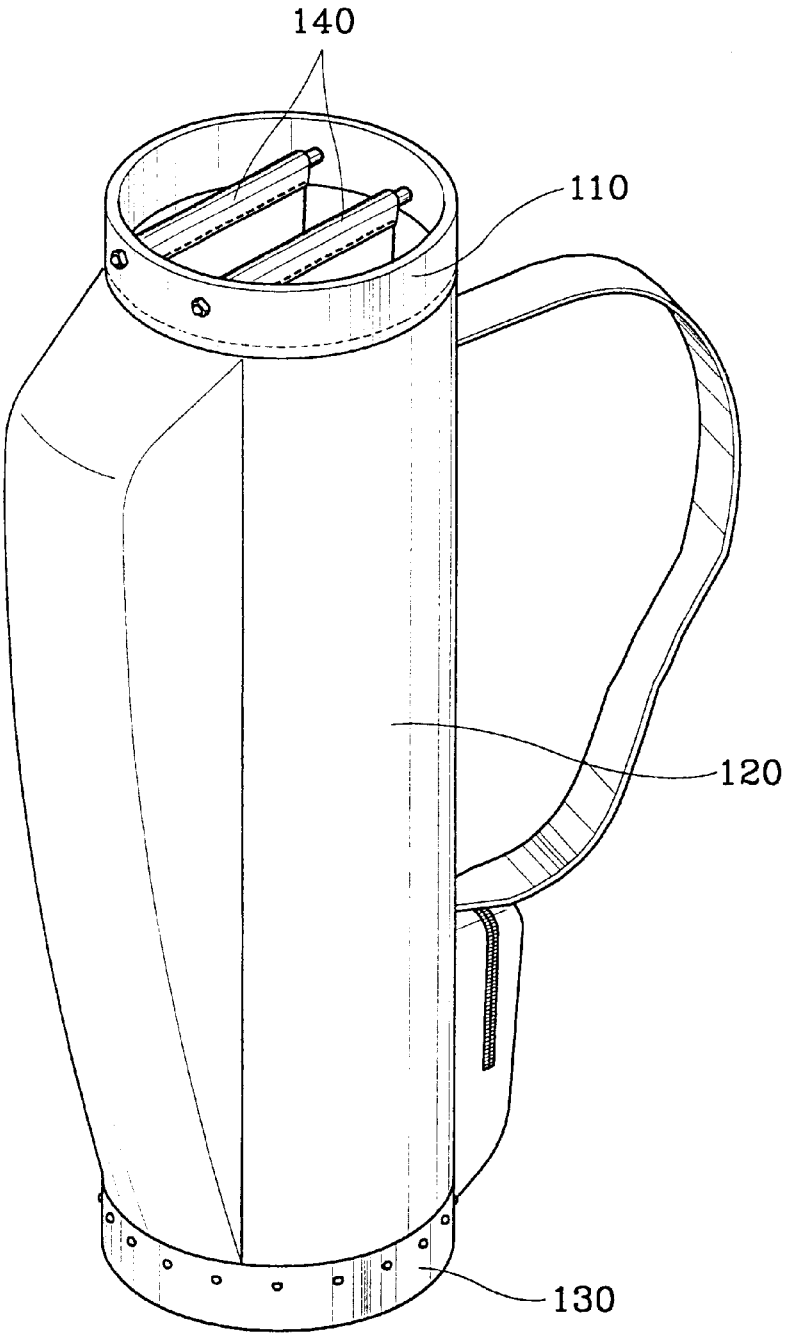
FIG.1 (PRIOR ART)
FIG. 1 is a schematic view of a golf bag in accordance with the prior art.
Figure 2:
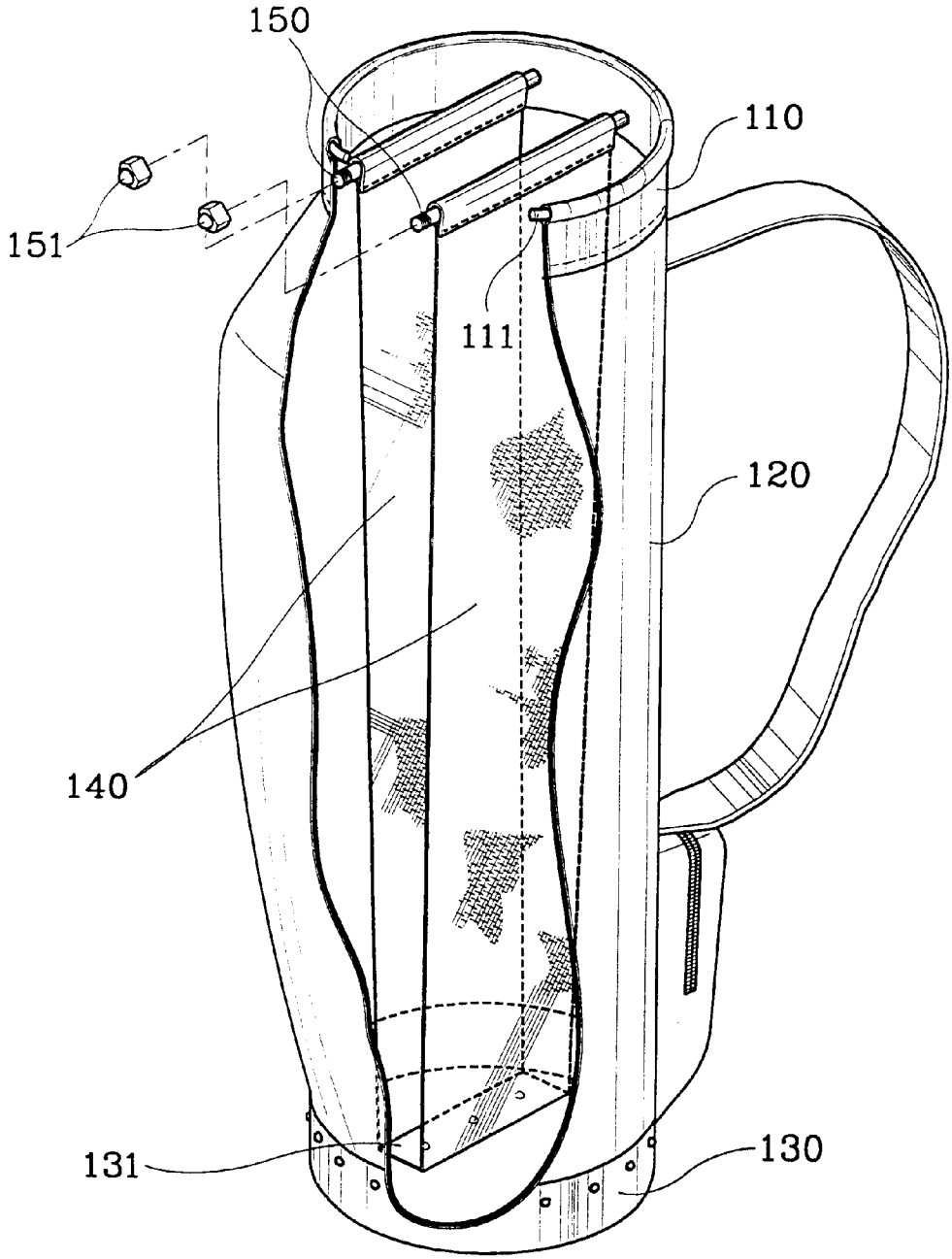
FIG. 2 (PRIOR ART)
FIG. 2 is a perspective view of a partially cut golf bag in FIG. 1.
Figure 3:
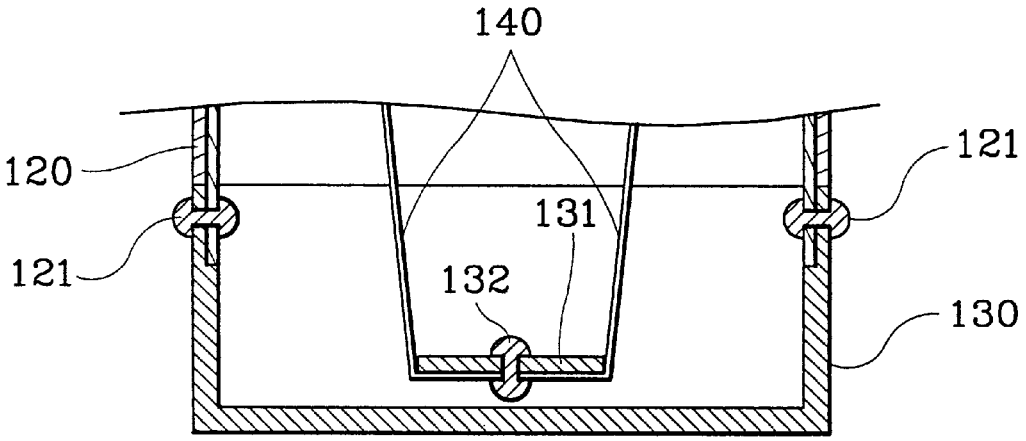
FIG.3 (PRIOR ART)
FIG. 3 is a longitudinal sectional view illustrating a portion where a body and a bottom of a golf bag are coupled.
Figure 4:
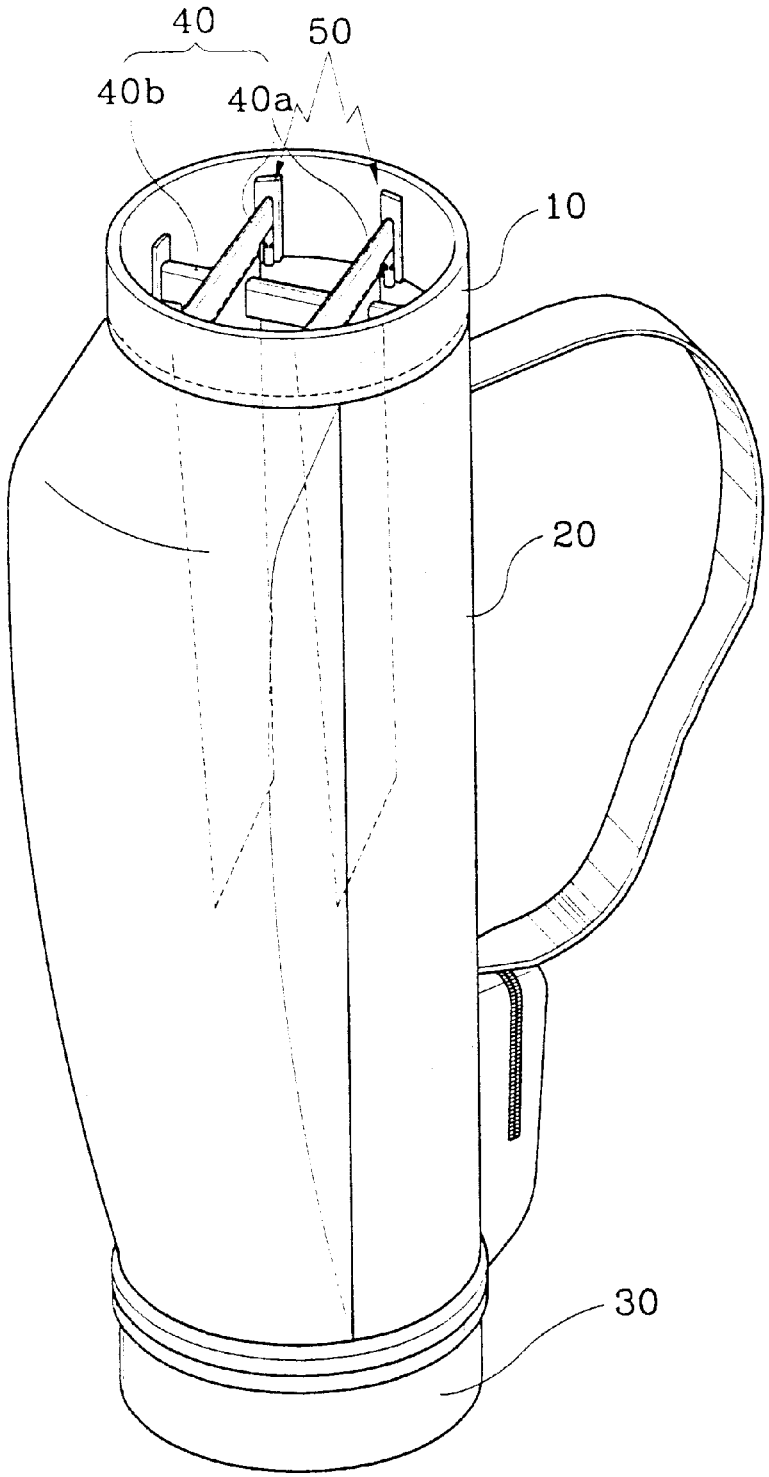
FIG. 4 is a schematic view of a golf bag in accordance with the present invention.
Figure 5:
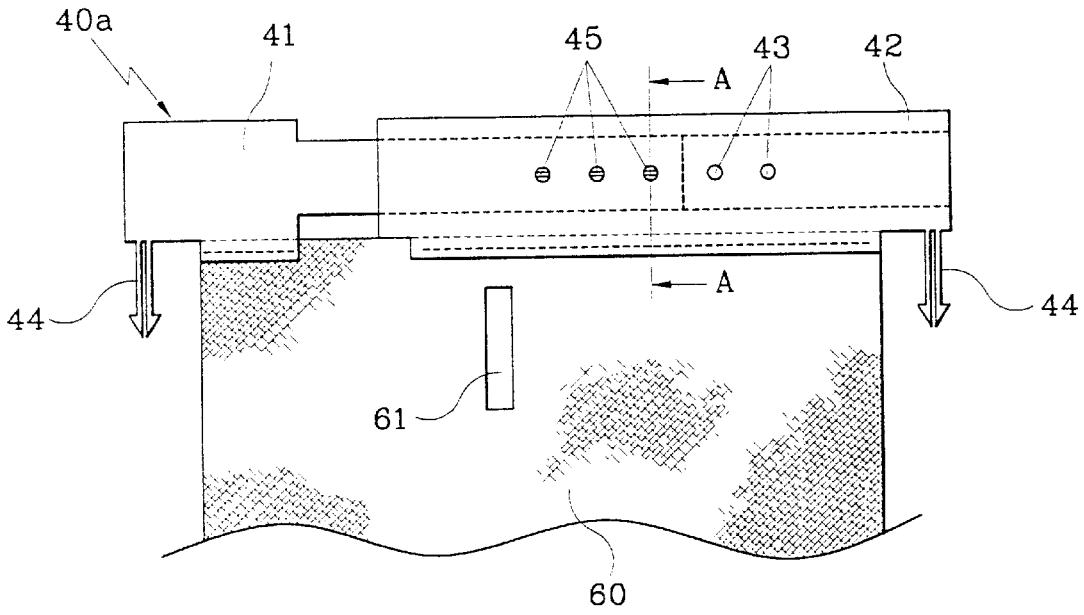
FIG. 5 is a front view of a vertical partitioning member in FIG. 4.
Figure 6:
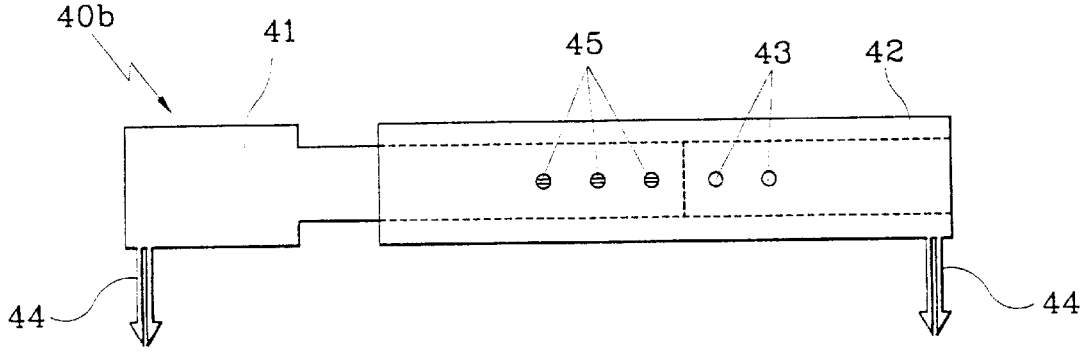
FIG. 6 is a front view of a horizontal partitioning member in FIG. 4.

An embodiment of the present invention is described in detail with reference to the accompanying drawings. FIG. 4 is a schematic view of a golf bag in accordance with the present invention. FIGS. 5 and 6 are respectively front views of the vertical and horizontal partitioning members.

As shown in the drawings, the present invention is a golf bag constructed of three major parts, a wire type of a top 10 where a wire 11 is embedded and sewn with fabric, a body 20 and a bottom 30 made of a synthetic material. The bag also includes partitioning members 40 which divide an internal space of the body with convenient and flexible adjustment of their length to a width of the top 10, regardless of the sizes of the bag, thereby improving assembling efficiency.

In other words, the partitioning members 40 include vertical and horizontal partitioning members for dividing the internal space of the bag in lattices. The vertical and horizontal partitioning members 40*a* and 40*b* are assembled when the hitching members 44 formed at both ends of vertical and horizontal partitioning members 40*a* and 40*b* are simply inserted into the accommodating members 50 formed at the inner side of the top 10.

First of all, construction of the partitioning members, whose length is adjustable, is described. As shown in FIGS. 5 and 6, the partitioning members 40*a* and 40*b* are provided with inserting members 41 and accommodating or receiving members 42 where the inserting members 41 are properly positioned. The inserting member 41 and accommodating member 42 are provided with a plurality of through holes 43 formed at a predetermined identical distance and inserting protruders 44 protruding downwardly at the respective ends thereof with a center portion thereof cut half. The through holes 43 formed at the inserting member 41 and accommodating member 42 are used for coupling with fasteners 45, thereby keeping constant the total length of the vertical and horizontal partitioning members 40*a* and 40*b*.

On the other hand, a baffling member 60 is sewn and fixed at a lower end of the vertical partitioning member 40*a* so as to extend down along the body 20. An open part 61 is formed at a central portion of the baffling member 60, and is big enough to accommodate the vertical partitioning member 40*b*.

Figure 7:
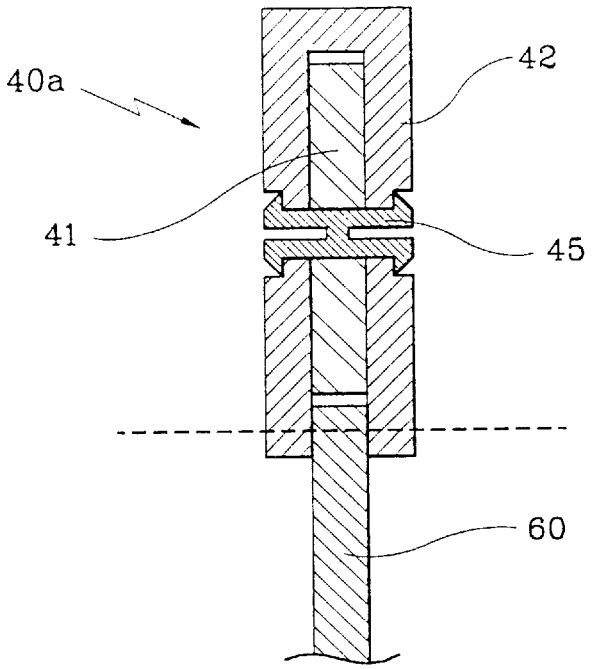
FIG. 7 is a sectional view taken along line A—A in FIG. 5.

As shown in FIG. 7, after one end of the inserting member 41 is inserted into the accommodating member 42, the inserting member 41 adjusted in the accommodating members 42 is fastened with fasteners 45 at the through holes 43 formed along the whole length of the partitioning member 40. Therefore, the whole length of the partitioning member 40 can be flexibly changed. When the horizontal partitioning member 40*b* is inserted into the open part 61 of the baffling member 60 sewn at the end of the vertical partitioning member 40*a*, the vertical partitioning member 40*a* and the horizontal partitioning member 40*b* are crossed to make the internal space of the top 10 into lattices. Hitching protuders 44 are disposed at respective ends of the inserting member 41 and the accommodating member 42 for being connected to the accommodating members 50, thereby fixing the same at the inner side of the top 10.

Figure 8:
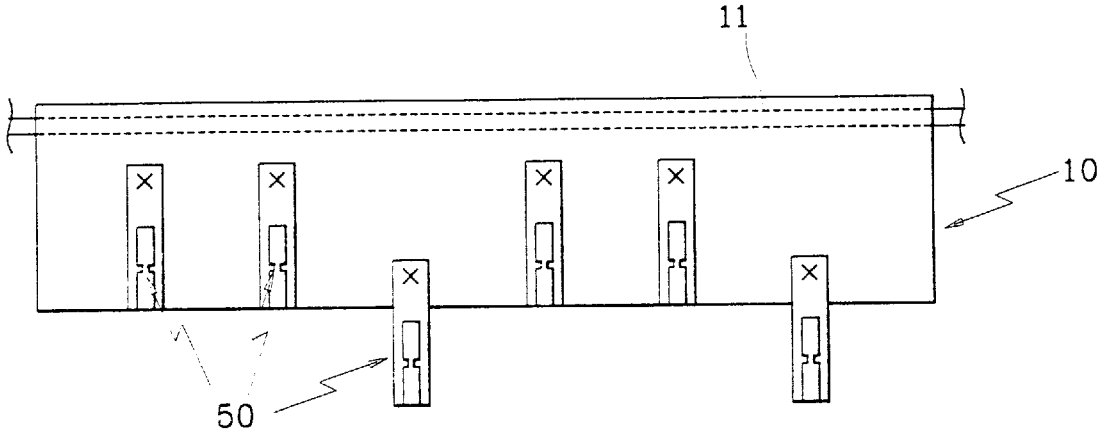
FIG. 8 is a development figure for illustrating an open state of a top shown in FIG. 4.

Next, a procedure of fastening the partitioning members 40*a* and 40*b* onto the top 10 is described in accordance with the present invention. As shown in FIG. 8, the accommodating members 50, formed at the inner side of the top 10 at predetermined identical intervals for fixing both ends of the vertical and horizontal partitioning members 40*a* and 40*b*, are classified into two types. One type is the accommodating members 50 arranged at a predetermined interval for fixing vertical partitioning members 40*a* at the inner side of the top 10 and the other type is the accommodating members 50 arranged at a predetermined interval for fixing horizontal partitioning members 40*b* at lower positions than those for fixing vertical partitioning members 40*a*.

Figure 9:
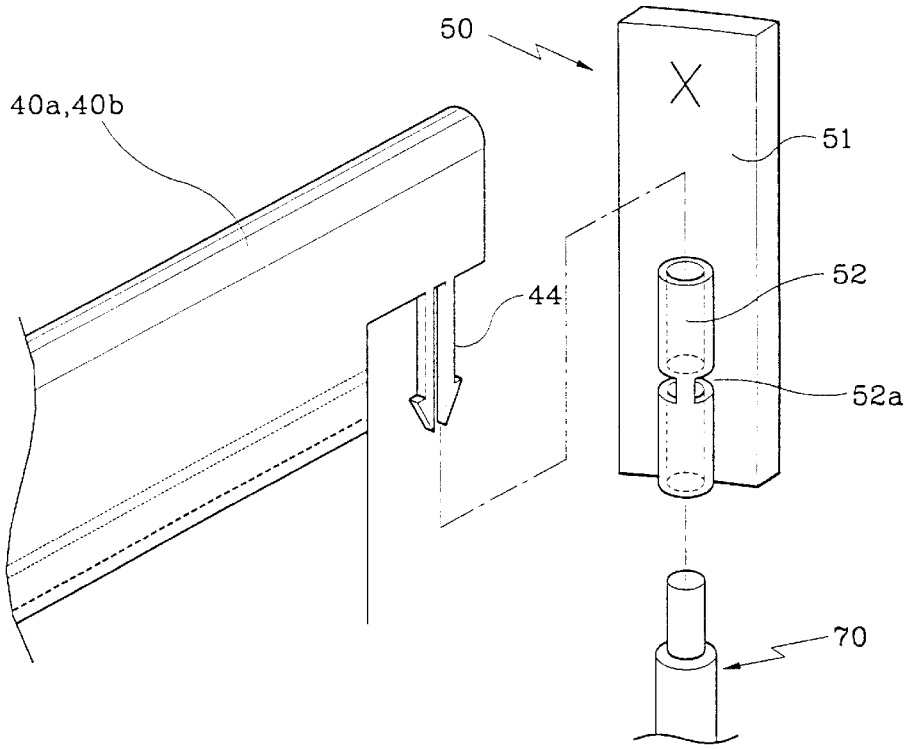
FIG. 9 is an analyzed perspective view for illustrating a portion where a partitioning member in FIGS. 6 and 8 and an inner side of a top in FIG. 5 are coupled.

At this time, the accommodating members 50, as shown in FIG. 9, include a flat member 51 sewn at the inner side of the top 10 and a cylindrical member 52 attached at a front portion of the flat member 51 with a cylindrical horizontal opening 52*a* formed at almost a center thereof.

By this, the inserting member 44 is inserted downward into the cylindrical member 52 attached at the front portion of the flat member 51 and the end of the inserting member 44 is projected out of the opening 52*a* for a tight fixation. The supporting rod 70 is inserted from under the cylindrical member 52.

A procedure is described to install the supporting rod 70 between the top 10 and the bottom 30 for internally supporting the body 20 made of a fabric, thereby maintaining the shape of the golf bag.

Figure 10:
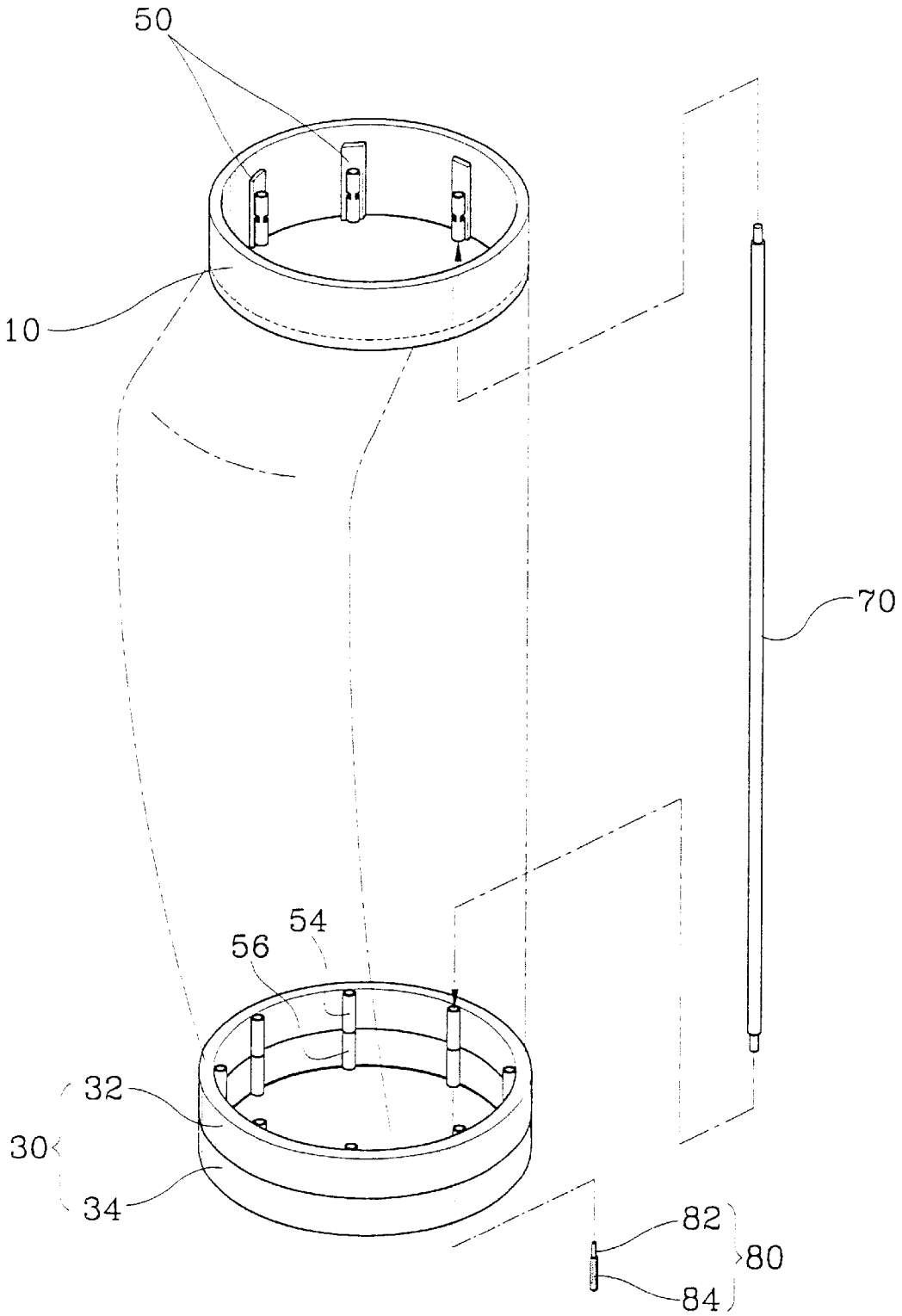
FIG. 10 is an analyzed perspective view of a supporting member which connects between a top and a bottom and supports a body as shown in FIG. 4.
Figure 11:
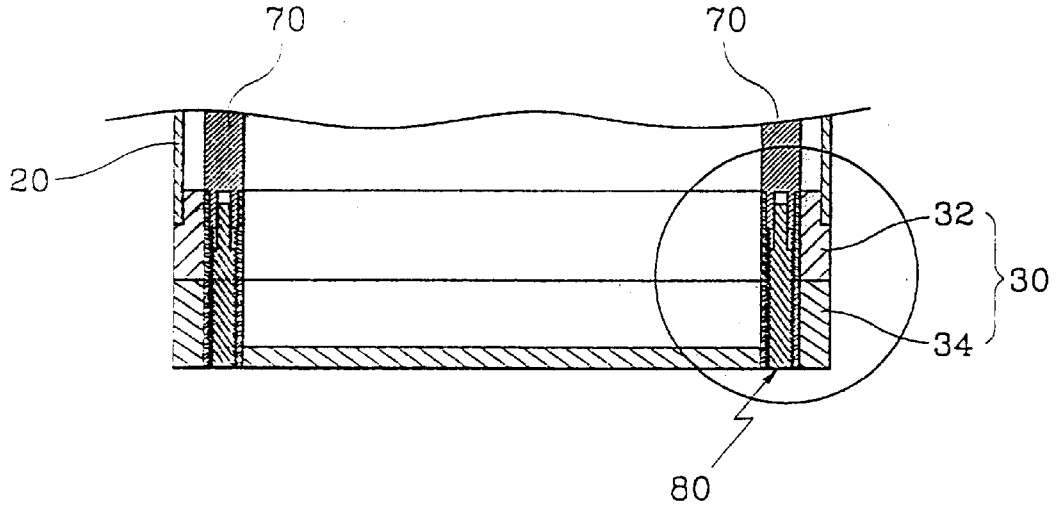
FIG. 11 is a longitudinal sectional view for illustrating a portion where a supporting member and a bottom in FIG. 10 are coupled.
Figure 12:
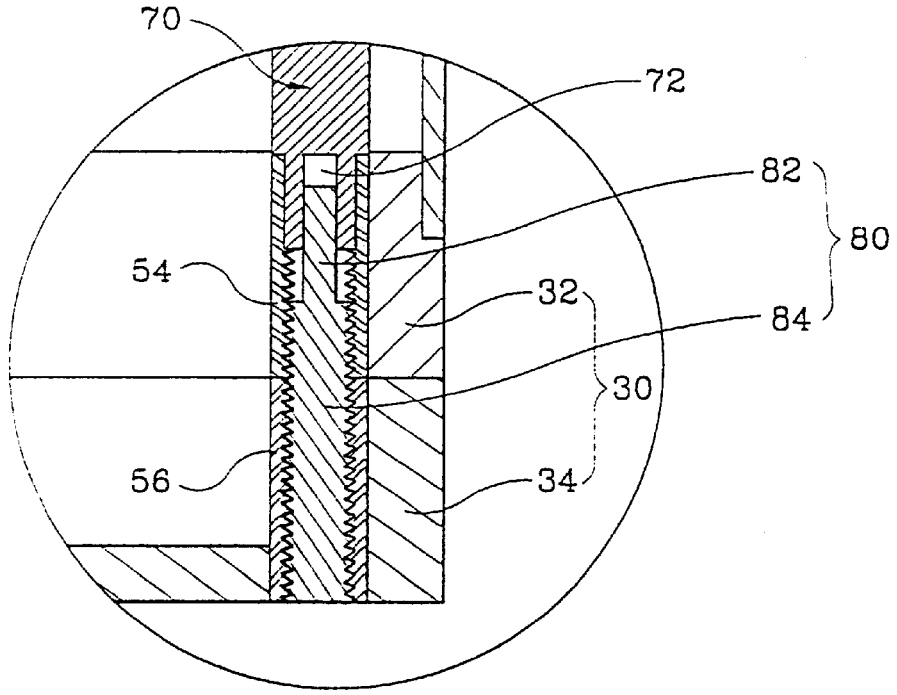
FIG. 12 is an enlarged sectional view for illustrating a portion where a supporting member and a bottom in FIG. 10 are coupled.

First of all, the bottom 30 made of a synthetic material, as shown in FIGS. 10 and 11, includes an upper member 32 and a lower member 34. The circular upper member 32 is permanently fixed with rivets at lower portions of the body 20 while the circular lower member 34 is attached by screws to the upper member 32. Both of the members 32 and 34 can be unscrewed for separation whenever necessary.

Cylindrical accommodating members 54 and 56 are attached around an inner side of the upper and lower members 32 and 34 of the bottom 30 at positions corresponding to the accommodating members 50 formed at predetermined intervals around the inner side of the top 10. The accommodating members 54 and 56 have holes with threads formed at the inner side thereof.

In addition, the accommodating members 56 attached at the lower member 34 have holes where fastening members 80 are used for sequentially screwing the accommodating members 56 and 54 of the lower and upper members 34 and 32.

The fastening member 80 has an integrated shape of different diameters. Each member 80 has a small diameter member 82 and a large diameter member 84 respecively. The small diameter member 82 has a diameter small enough to be inserted into the opening 72 formed at a lower end of the supporting rod 70. The large diameter member 84 has a cylindrical shape with a screw thread at an external periphery thereof for being screwed into the accommodating members 54 and 56.

When the supporting rod 70 is disposed between the top 10 and bottom 30 for supporting the body 20, the upper end thereof is inserted upward to the lower portion of the cylindrical member 52 of the accommodating member 50 attached at the inner periphery of the top 10. The lower end thereof is inserted downward to the upper portion of the accommodating member 54 attached at the inner periphery of the upper member 32. Afterwards, the fastening member 80 is inserted upwardly for being sequentially screwed into the accommodating members 54 and 56. When the small diameter member 82 of the fastening member 80 is inserted into the opening 72 formed at the lower end of the supporting rod 70, the lower end of the supporting rod 70 is additionally fixed.

On the other hand, when the fastening member 80 is unscrewed, the accommodating members 56 and 54 of the lower and upper members 34 and 32 are disassembled, whereby the lower member 34 is separated from the upper member 32.

However, if the golf bag has a cylindrical frame type of body (not shown) which does not need a supporting rod 70 between the top 10 and bottom 30, the accommodating members 54 and 56 are not needed at the bottom 30.

There is an advantage of the present invention in that a golf bag of the present invention comprises a top 10 embedded with a circular wire covered with fabric thereon, a body 20 and a bottom 30 connected to the body 20 in an easy attachment and detachment, wherein partitioning members, whose length being conveniently adjusted to a width of the top, are assembled to the top for dividing the internal space of the body in a plurality of lattices, thereby efficiently corresponding to the manufacturing processes of various sizes and shapes of the golf bags.

There is another advantage in the present invention in that partitioning members 40 and accommodating members 50 are used for a simple inserting assembly method instead of a difficult screw method in the prior art, thereby reducing in manufacturing time and improving job efficiency.

There is a still advantage in the present invention in that a rod stay type of body using a plurality of supporting rods 70 between the top 10 and the bottom 30 can be used, thereby further expanding applications of the wire type of golf bags.

There is a still further advantage in the present invention in that the bottom 30 can be attached to or detached from the body 20, thereby allowing an easy disassembly in case the body needs repairing.

What is claimed is:

1. A golf bag having an open top for arranging a plurality of golf clubs, a body coupled along the periphery of a lower end of the top, a bottom disposed along the periphery of a lower end of the body for closing up an internal space of the body and partitioning members fixed at the top for dividing the internal space, the bag comprising:

vertically extending hitching protruders formed at both ends of the partitioning members;

vertically extending accommodating members installed along an inner side of the top for fixedly receiving the hitching protruders, wherein the hitching protruders of the partitioning members fit into the accommodating members to thereby fix them to the top, wherein each accommodating member comprises a flat member attached at an inner side of the top and a cylindrical member disposed at a front portion of the flat member, the cylindrical member including a horizontal opening.

2. The golf bag as defined in claim 1, wherein the partitioning members further comprise inserting members and receiving members that are movable relative to one another so that the length of the partitioning member can be adjusted.

3. The golf bag as defined in claim 2, wherein the inserting members and the receiving members include a plurality of through holes at predetermined intervals along the length thereof and the hitching protruders extend downwardly at both ends thereof.

4. The golf bag as defined in claim 2, wherein at least one partitioning member has a baffling member fixed at a lower end thereof, the baffling member being disposed inside the body and including an opening for accommodating another partitioning member.

5. The golf bag as defined in claim 1, wherein the bottom comprises an upper member attached to a lower end of the body and a lower member fastened to the upper member with a fastening member for easy disassembly.

6. The golf bag as defined in claim 5, the upper and lower members comprise accommodating members attached at an inner periphery thereof corresponding to the accommodating members attached at an inner periphery of a top wherein a lower end of a supporting rod is fixed by a screw.

* * * * *